US011408077B2

(12) United States Patent
Morris et al.

(10) Patent No.: US 11,408,077 B2
(45) Date of Patent: Aug. 9, 2022

(54) PERMANGANATE BASED CONVERSION COATING COMPOSITIONS

(71) Applicant: PRC-DeSoto International, Inc., Sylmar, CA (US)

(72) Inventors: Eric L. Morris, Murrieta, CA (US); Jane B. Moon, Fullerton, CA (US)

(73) Assignee: PRC-DESOTO INTERNATIONAL, INC., Sylmar, CA (US)

( * ) Notice: Subject to any disclaimer, the term of this patent is extended or adjusted under 35 U.S.C. 154(b) by 0 days.

(21) Appl. No.: 16/888,994

(22) Filed: Jun. 1, 2020

(65) Prior Publication Data

US 2020/0354837 A1 Nov. 12, 2020

Related U.S. Application Data

(62) Division of application No. 14/891,050, filed as application No. PCT/US2014/037695 on May 12, 2014, now abandoned.

(60) Provisional application No. 61/823,288, filed on May 14, 2013.

(51) Int. Cl.

| | |
|---|---|
| ***C23C 22/66*** | (2006.01) |
| ***C23C 22/68*** | (2006.01) |
| ***B05D 5/00*** | (2006.01) |
| ***B05D 7/14*** | (2006.01) |
| ***B05D 7/00*** | (2006.01) |
| ***C23G 1/22*** | (2006.01) |
| ***C23G 1/24*** | (2006.01) |
| ***C23C 22/56*** | (2006.01) |
| ***C23C 22/83*** | (2006.01) |

(52) U.S. Cl.

CPC ..... *C23C 22/56* (2013.01); *B05D 5/00* (2013.01); *B05D 7/14* (2013.01); *B05D 7/54* (2013.01); *C23C 22/66* (2013.01); *C23C 22/68* (2013.01); *C23C 22/83* (2013.01); *C23G 1/22* (2013.01); *C23G 1/24* (2013.01)

(58) Field of Classification Search

None

See application file for complete search history.

(56) References Cited

U.S. PATENT DOCUMENTS

| | | | | |
|---|---|---|---|---|
| 3,236,641 | A | 2/1966 | Nepela | |
| 3,962,061 | A | 6/1976 | Nikaido et al. | |
| 4,755,224 | A * | 7/1988 | Bibber | C23C 22/66 106/14.21 |
| 5,192,374 | A * | 3/1993 | Kindler | C23C 22/83 148/272 |
| 6,087,017 | A * | 7/2000 | Bibber | C08G 63/48 106/13 |
| 6,304,344 | B1 | 10/2001 | Brandestini et al. | |
| 6,361,833 | B1 | 3/2002 | Nakada et al. | |
| 7,084,343 | B1 * | 8/2006 | Visser | C09D 167/00 174/102 R |
| 7,214,304 | B2 | 5/2007 | Lee et al. | |
| 7,452,427 | B2 | 11/2008 | Morris | |
| 2003/0098092 | A1 * | 5/2003 | Minevski | C23C 22/66 148/273 |
| 2003/0234063 | A1 | 12/2003 | Sturgill et al. | |
| 2004/0020568 | A1 | 2/2004 | Phelps et al. | |
| 2004/0137246 | A1 | 7/2004 | Fristad et al. | |
| 2005/0181137 | A1 | 8/2005 | Straus | |
| 2009/0215269 | A1 | 8/2009 | Boggs et al. | |
| 2011/0094630 | A1 | 4/2011 | Yoshida et al. | |
| 2012/0025142 | A1 * | 2/2012 | Visser | C09D 5/084 252/389.61 |
| 2012/0171502 | A1 | 7/2012 | Chang et al. | |
| 2013/0052352 | A1 | 2/2013 | Cano-Iranzo et al. | |

FOREIGN PATENT DOCUMENTS

| | | |
|---|---|---|
| CN | 102650068 | 8/2012 |
| JP | S5741376 | 3/1982 |
| JP | S6362885 | 3/1988 |
| JP | H08144063 | 6/1996 |
| JP | H10219473 | 8/1998 |
| JP | 2002332575 | 11/2002 |
| JP | 2003231976 | 8/2003 |
| JP | 2005097701 | 4/2005 |
| JP | 2007251175 | 9/2007 |
| WO | 9851841 | 11/1998 |
| WO | 2005080009 | 9/2005 |
| WO | 2010117479 | 10/2010 |
| WO | 2011001653 | 1/2011 |

OTHER PUBLICATIONS

Buchheit et al., "Chromate-Free Corrosion Resistant Conversion Coatings for Aluminum Alloys", Technical Report—1995 Annual Meeting and Exhibition of the Minerals, Metals and Materials Society, Feb. 12, 1996, 10 pages.

* cited by examiner

*Primary Examiner* — Joseph D Anthony
(74) *Attorney, Agent, or Firm* — Alicia M. Passerin; Ashley N. Crane

(57) ABSTRACT

A composition for application to a substrate comprising a carrier, a permanganate ion source, and a corrosion inhibitor comprising a rare earth ion, an alkali metal ion, an alkaline earth metal ion, and/or a transition metal ion is disclosed. A substrate or article including the composition for application to a substrate, and a method of treating a substrate comprising applying the composition to a substrate to form a permanganate treated surface of the substrate, and applying a lithium containing composition on the permanganate treated surface are also disclosed.

15 Claims, No Drawings

PERMANGANATE BASED CONVERSION COATING COMPOSITIONS

CROSS-REFERENCE TO RELATED APPLICATION

This application is a divisional application of U.S. patent application Ser. No. 14/891,050, filed on Nov. 13, 2015, entitled "Permanganate Based Conversion Coating Compositions", which is a 371 national stage entry of PCT/US2014/037695, filed on May 12, 2014, which claims the benefit of U.S. Provisional Application Ser. No. 61/823,288, filed on May 14, 2013, the entire contents of which are incorporated herein by reference.

BACKGROUND

The oxidation and degradation of metals used in aerospace, commercial, and private industries are serious and costly problems. To prevent or reduce the oxidation and degradation of the metals used in these applications, a protective coating can be applied to the metal surface. This protective coating may be the only coating applied to the metal, or other coatings can be applied to further protect the metal surface.

Corrosion resistant coatings are known in the art of metal finishing, and older technologies involve chromium based coatings which have an undesirable environmental impact. Other corrosion resistant coatings are also known, including some chromium free coatings and/or pre-treatment coatings that may prevent or reduce oxidation and degradation of metals and aid in corrosion resistance. Metal surface coatings that can provide corrosion resistance and also aid in the prevention or reduction of oxidation and degradation are desired.

SUMMARY

According to embodiments of the present invention, a composition for application to a substrate comprises a carrier, a permanganate anion source, and a corrosion inhibitor comprising a rare earth ion, an alkali metal ion, an alkaline earth metal ion, and/or a transition metal ion. Methods for using the composition and articles coated therewith are also within the scope of the present invention.

DETAILED DESCRIPTION

According to embodiments of the present invention, a composition for application to a metal substrate comprises a carrier, a permanganate anion source, and a corrosion inhibitor comprising a metal cation. In some embodiments, the metal cation comprises a rare earth species (e.g., Ce (cerium) and/or Y (yttrium) cations), a transition metal species (e.g., Zr (zirconium), Zn (zinc) and/or Ti (titanium), a Group IIA (or Group 2) metal cation (e.g., Mg) and/or a Group IA (or Group 1) metal cation (e.g., Li (lithium)). In some embodiments, the metal cation may include Cr (chromium). However, in other embodiments, the composition is substantially chromium-free. As used herein, the term "substantially" is used as a term of approximation and not as a term of degree. Additionally, the term "substantially chromium-free" is used as a term of approximation to denote that the amount of chromium in the composition is negligible, such that if chromium is present in the composition at all, it is as an incidental impurity. According to some embodiments, the metal cation is provided in the composition in the form of a salt, and the salt may comprise, for example, nitrate or carbonate counter ions.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

The term "substrate," as used herein, refers to a material having a surface. In reference to applying a conversion coating, the term "substrate" refers to a metal substrate such as aluminum, iron, copper, zinc, nickel, magnesium, and/or an alloy of any of these metals including but not limited to steel. Some exemplary substrates include aluminum and aluminum alloys. Additional exemplary substrates include high copper aluminum substrates (i.e., substrates including an alloy containing both aluminum and copper in which the amount of copper in the alloy is high, for example, an amount of copper in the alloy of 3 to 4%).

The term "coating," and like terms, when used as a verb herein, refers to the process of applying a composition, i.e., contacting a substrate with a composition, such as contacting a substrate with a conversion coating, primer, and/or topcoat. The term "coating" may be used interchangeably with the terms "application/applying," "treatment/treating" or "pretreatment/pretreating", and may also be used to indicate various forms of application or treatment, such as painting, spraying and dipping (e.g., immersion, spraying, or spreading using a brush, roller, or the like), where a substrate is contacted with a composition by such application means. With regard to application via spraying, conventional (automatic or manual) spray techniques and equipment used for air spraying can be used. The composition can be applied in paste or gel form. The composition may be applied in any suitable thickness, depending on the application requirements. More than one coat of the composition may be applied. All or part of the substrate can be contacted. That is, the compositions of the present invention can be applied to at least a portion of a substrate.

The term "conversion coating," also referred to herein as a "conversion treatment" or "pretreatment," refers to a treatment for a metal substrate that causes the chemistry of the metal surface to be converted to a different surface chemistry. The terms "conversion treatment" and "conversion coating" also refer to the application or treatment of a metal surface in which a metal substrate is contacted with an aqueous solution having a metal of a different element than the metal contained in the substrate. Additionally, the terms "conversion coating" and "conversion treatment" refer to an aqueous solution having a metal element in contact with a metal substrate of a different element, in which the surface of the substrate partially dissolves in the aqueous solution, leading to the precipitation of a coating on the metal substrate (optionally using an external driving force to deposit the coating on the metal substrate). The resulting film is thus a combination of both the metal(s) in solution as well as the metal(s) of the metallic substrate.

The term "salt," as used herein, refers to an ionically bonded inorganic compound and/or the ionized anion and cation of one or more inorganic compounds in solution.

As used herein, the term "permanganate" refers to a salt containing the manganate (VII) ion ($MnO_4$). Exemplary permanganate compounds include ammonium permanganate ($NH_4MnO_4$), potassium permanganate ($KMnO_4$), and sodium permanganate ($NaMnO_4$).

The term "rare earth element," as used herein, refers to an element in Group IIIB (or the lanthanide series) of the periodic table of the elements or yttrium. The group of elements known as the rare earth elements includes, for example, elements 57-71 (i.e., La, Ce, Pr, Nd, Pm, Sm, Eu, Gd, Tb, Dy, Ho, Er, Tm, Yb and Lu) and yttrium. In some embodiments, however, as noted below, the term rare earth element may refer to La, Ce, Pr, Nd, Sm, Eu, Gd, Tb, Dy, Ho, Er, Tm, Yb, Lu and Y.

The term "Group IA metal ion," or "Group 1 metal ion" and like terms, as used herein, refer to an ion or ions of elements from the first column of the periodic table (with the exception of H). The group of elements identified by Group IA or Group 1 (with the exception of H) is also known as the alkali metals, and includes, for example, Li, Na, K, Rb, Cs, and Fr.

The term "Group IIA metal ion," or "Group 2 metal ion" and like terms, as used herein, refer to an ion or ions of elements from the second column of the periodic table. The group of elements identified by Group IIA or Group 2 is also known as the alkaline earth metals, and includes, for example, Be, Mg, Ca, Sr, Ba and Ra.

The term "solution" refers to a composition comprising a solvent and a solute, and includes true solutions and suspensions. Examples of solutions include a solid, liquid or gas dissolved in a liquid and particulates or micelles suspended in a liquid.

All amounts disclosed herein are given in weight percent of the total weight of the composition at 25° C. and one atmosphere pressure, unless otherwise indicated.

Permanganate Compositions

According to some embodiments of the present invention, a permanganate-containing composition for application to a metal substrate (e.g., a substrate comprising aluminum, magnesium, iron, zinc, nickel, and/or an alloy thereof) comprises a permanganate anion source, a corrosion inhibitor comprising a metal cation, and a carrier. The permanganate-containing compositions described herein can be used without borates, halides, or at elevated temperatures. In addition, the permanganate-containing compositions are compatible with alkaline and acidic deoxidizers; they do not require pre-exposure of the substrate with, e.g., lithium nitrate, nor do they require pre-treatment by elevated temperature water immersion.

The permanganate source may comprise a permanganate salt or a combination of permanganate salts. The permanganate salt may include any alkali metal (i.e., Group IA or Group 1) cation, alkaline earth metal (i.e., Group IIA or Group 2) cation, or an ammonium cation in addition to the manganate anion. For example, in some embodiments, the alkali or alkaline earth metal cation may comprise Li, Na, K, Rb, Cs, Fr, Be, Mg, Ca, Sr, Ba and/or Ra. In some embodiments, the alkali metal or alkaline earth metal cation comprises Li, Na, K, Rb, Cs, Be, Mg, Ca, Sr and/or Ba. For example, in some embodiments, the rare earth element comprises Na, K, Mg and/or Ca. Some nonlimiting examples of suitable permanganate sources include permanganate salts such as potassium permanganate, sodium permanganate and ammonium permanganate.

In some embodiments, the composition may be an aqueous coating composition, and the composition may therefore further include an aqueous carrier which may optionally comprise one or more organic solvents. Nonlimiting examples of suitable such solvents include propylene glycol, ethylene glycol, glycerol, low molecular weight alcohols, and the like. When used, the organic solvent may be present in the composition in an amount of 30 g solvent per 12 liters of composition to 400 g solvent per 12 liters of composition, with the remainder of the carrier being water. For example, in some embodiments, the organic solvent may be present in the composition in an amount of 100 g solvent per 12 liters of composition to 200 g solvent per 12 liters of composition, for example 107 g solvent per 12 liters of composition, with the remainder of the carrier being water. In some embodiments, however, the aqueous carrier is primarily water, e.g., deionized water. The aqueous carrier is provided in an amount sufficient to provide the composition with the concentrations of the metal ions and permanganate sources described herein.

The concentration of the permanganate source in the composition may be 0.008 percent by weight up to the solubility limit of the permanganate source in the carrier. In some embodiments, the permanganate source may be present in the composition in a concentration of 0.01% to 6.0% by weight. For example, in some embodiments, the permanganate source may be present in the composition in a concentration of 0.0375% to 0.15% by weight.

As noted above, the permanganate containing composition may further comprise a corrosion inhibitor comprising a metal cation. The metal cation may comprise one or more of various metal cations which have corrosion inhibiting characteristics. For example, in some embodiments, the metal cation may comprise a rare earth element, such as, for example, La, Ce, Pr, Nd, Pm, Sm, Eu, Gd, Tb, Dy, Ho, Er, Tm, Yb, Lu. In some embodiments, the rare earth element comprises La, Ce, Pr, Nd, Sm, Eu, Gd, Tb, Dy, Ho, Er, Tm, Yb, Lu and/or Y. For example, in some embodiments, the rare earth element comprises Ce, Y, Pr and/or Nd. Other suitable metal cations include Group IA (or Group 1) or Group IIA (or Group 2) metal cations (i.e., the alkali metals and alkaline earth metals). For example, in some embodiments, the metal cation may comprise an alkali metal, such as, for example, Li, Na, K, Rb, Cs and/or Fr, and/or an alkaline earth metal, such as, for example, Be, Mg, Ca, Sr, Ba and/or Ra. Other suitable metal cations include transition metal cations (e.g., Zr and/or Zn). Also, as discussed above, in some embodiments, the metal cation may include Cr (chromium). However, in other embodiments, the composition is substantially chromium-free. As used herein, the term "substantially" is used as a term of approximation and not as a term of degree. Additionally, the term "substantially chromium-free" is used as a term of approximation to denote that the amount of chromium in the composition is negligible, such that if chromium is present in the composition at all, it is as an incidental impurity. In some embodiments, for example, the metal cation may comprise Ce, Y, Pr, Nd, Zr, Zn, Li, Na, K and/or Mg. In some example embodiments, the metal cation comprises an alkali metal, such as, for example, Li, Na, K, Rb and/or Cs, and/or an alkaline earth metal, such as, for example, Be, Mg, Ca, Sr and/or Ba. In some embodiments, for example, the metal cation comprises lithium, sodium, potassium, and/or magnesium. In other embodiments, the metal cation comprises Ce, Y, Nd and/or Li or transition metal cations (e.g., Zr and/or Zn). In some embodiments, for example, the metal cation may comprise Ce, Y, Pr, Nd, Zr, Zn, Li, Na, K and/or Mg.

The metal cation can be present in the composition at a concentration of 0.0008 and 0.2 percent by weight of the composition. For example, in some embodiments, the metal cation may be present in the composition at a concentration of 0.002 and 0.004 percent by weight. In some embodiments, for example, the metal cation can be present in the composition at a concentration of 0.05 g per liter of composition to 25 g per liter of composition. For example, in some embodiments, the metal cation can be present in the composition at a concentration of 0.05 g per liter of composition to 16 g per liter of composition. In some embodiments, for example, the metal cation can be present in the composition at a concentration of 0.1 g per liter of composition to 10 g per liter of composition. For example, in some embodiments, the metal cation can be present in the composition at a concentration of 1 g per liter of composition to 5 g per liter of composition. For example, when the metal cation includes a rare earth cation, the rare earth cation may be present at a concentration of 0.05 g per liter of composition to 25 g per liter of composition, or 0.1 g per liter of composition to 10 g per liter of composition. When the metal cation includes an alkali metal or alkaline earth metal cation, the alkali metal or alkaline earth metal cation may be present at a concentration of 0.05 g per liter of composition to 16 g per liter of composition, or 1 g per liter of composition to 5 g per liter of composition. As discussed in further detail below, the metal cation may be provided in the composition in the form of a metal salt, in which case, the amounts listed here reflect the amount of the salt in the composition.

As noted above, the metal cation may be provided in the composition in the form of a salt (i.e., a metal salt may serve as the source for the metal cation in the composition) having an anion and the metal cation as the cation of the salt. The anion of the salt may be any suitable anion capable of forming a salt with the rare earth elements, alkali metals, alkaline earth metals, and/or transition metals. Nonlimiting examples of anions suitable for forming a salt with alkali metals, alkaline earth metals, transition metals and rare earth elements include carbonates, hydroxides, nitrates, halides (e.g., $Cl^-$, $Br^-$, $I^-$ or $F^-$), sulfates, phosphates and silicates (e.g., orthosilicates and metasilicates). For example, the metal salt may comprise a carbonate, hydroxide, halide, nitrate, sulfate, phosphate and/or silicate (e.g., orthosilicate or metasilicate) of Cr, Li, Na, K, Rb, Cs, Fr, Be, Mg, Ca, Sr, Ba, Ra, Y, La, Ce, Pr, Nd, Pm, Sm, Eu, Gd, Tb, Dy, Ho, Er, Tm, Yb, Lu, Sc, Ti, Zr, Hf, Rf, V, Nb, Ta, Db, Cr, Mo, W, Sg, Mn, Tc, Re, Bh, Fe, Ru, Os, Hs, Co, Rh, Ir, Mt, Ni, Pd, Pt, Ds, Cu, Ag, Au, Rg, Zn, Cd, Hg and/or Cn. In some embodiments for example, the metal salt may comprise a carbonate, hydroxide, halide, nitrate, sulfate, phosphate and/or silicate (e.g., orthosilicate or metasilicate) of Cr, Li, Na, K, Rb, Cs, Be, Mg, Ca, Sr, Ba, Y, La, Ce, Pr, Nd, Sm, Eu, Gd, Tb, Dy, Ho, Er, Tm, Yb, Lu, Sc, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd and/or Hg. In some embodiments, for example, the metal salt may comprise a carbonate, hydroxide, halide, nitrate, sulfate, phosphate and/or silicate (e.g., orthosilicate or metasilicate) of Cr, Li, Na, K, Rb, Cs, Be, Mg, Ca, Sr, Ba, Y, La, Ce, Pr, Nd, Sm, Eu, Gd, Tb, Dy, Ho, Er, Tm, Yb, Lu, Sc, Ti, Zr, Hf, V, Nb, Ta, Mo, W, Mn, Tc, Re, Ru, Os, Co, Rh, Ir, Pd, Pt, Ag, Au, Zn, Cd and/or Hg. For example, in some embodiments, the metal salt may comprise a carbonate, hydroxide, halide, nitrate, sulfate, phosphate and/or silicate (e.g., orthosilicate or metasilicate) of Cr, La, Ce, Y, Pr, Nd, Zr, Zn, Li, Na, K and/or Mg. In some embodiments, for example, the permanganate composition may include sodium hydroxide. Additionally, in some embodiments, the composition may include at least two metal salts, and the at least two metal salts may comprise different anions and/or cations from each other. For example, the at least two metal salts may comprise different anions but the same cations, or may comprise different cations but the same anions. In some embodiments, for example, the metal cation is provided in the composition in the form of a metal salt such as a zinc salt, a zirconium salt, a titanium salt, a chromium salt, a lithium salt, and/or a rare earth salt. As noted above, the zinc, zirconium, titanium, chromium, lithium, and/or rare earth salt may be present in the permanganate-containing composition at a concentration of 0.0008 to 0.2 percent by weight of the composition, for example 0.002 to 0.004 percent by weight of the composition.

In some embodiments, the permanganate-containing composition may further comprise an azole compound. The azole compound may include cyclic compounds having 1 nitrogen atoms, such as pyrroles, 2 or more nitrogen atoms, such as pyrazoles, imidazoles, triazoles, tetrazoles and pentazoles, 1 nitrogen atom and 1 oxygen atom, such as oxazoles and isoxazoles, and 1 nitrogen atom and 1 sulfur atom, such as thiazoles and isothiazoles. Nonlimiting examples of suitable azole compounds include 2,5-dimercapto-1,3,4-thiadiazole (CAS:1072-71-5), 1H-benzotriazole (CAS: 95-14-7), 1H-1,2,3-triazole (CAS: 288-36-8), 2-amino-5-mercapto-1,3,4-thiadiazole (CAS: 2349-67-9), also named 5-amino-1,3,4-thiadiazole-2-thiol, and 2-amino-1,3,4-thiadiazole (CAS: 4005-51-0). In some embodiments, for example, the azole compound comprises 2,5-dimercapto-1,3,4-thiadiazole.

The azole compound may be present in the composition at a concentration of 0.0005 g per liter of composition to 3 g per liter of composition. For example, in some embodiments, the azole compound may be present in the composition at a concentration of 0.004 g per liter of composition to 0.1 g per liter of composition. In some embodiments, the azole compound may be present in the composition at a concentration of 0.0008 to 0.2 weight percent, for example 0.002 to 0.004 weight percent.

In some embodiments, the composition may further comprise an oxidizing agent. Any suitable oxidizing agent may be used, nonlimiting examples of which include organic peroxides, such as benzoyl peroxides, ozone and nitrates. One nonlimiting example of a suitable oxidizing agent is hydrogen peroxide. In some embodiments, the oxidizing agent may be present in the composition in an amount of 0.001 wt % to 15 wt %. For example, in some embodiments the oxidizing agent may comprise a 30% solution of hydrogen peroxide present in an amount of 0.001 wt % to 15 wt %, for example 0.002 wt % to 0.006 wt %, or 0.008 wt % to 0.08 wt %. Addition of an oxidizing agent, such as hydrogen peroxide, to a permanganate-containing composition may cause the peroxide to decompose quickly, and therefore, caution should be used when adding an oxidizing agent to the permanganate-containing composition.

In some embodiments of the present invention, the permanganate-containing composition may further comprise one or more additives for promoting corrosion resistance, adhesion to the metal substrate, adhesion of subsequent coatings, and/or to provide another desired aesthetic or functional effect. An additive, if used, may be present in the composition in an amount of 0.0001 weight percent up to 80 weight percent based on the total weight of the composition. These optional additives may be chosen based on the desired function of the resulting coating and/or its application or intended use. Suitable additives may include a solid or liquid component admixed with the composition for the purpose of affecting one or more properties of the composition. The additive may include, for example, a surfactant, which can assist in wetting the metal substrate, and/or other additives that can assist in the development of a particular surface property, such as a rough or smooth surface. Other nonlimiting examples of suitable additives include alcohols, co-inhibitors, lithium salts, flow control agents, thixotropic agents such as bentonite clay, gelatins, cellulose, anti-gassing agents, degreasing agents, anti-foaming agents, organic co-solvents, catalysts, dyes, amino acids, urea based compounds, complexing agents, valence stabilizers, and the like, as well as other customary auxiliaries. Suitable additives are known in the art of formulating compositions for surface coatings and can be used in the compositions according to embodiments of the present invention, as would be understood by those of ordinary skill in the art with reference to this disclosure.

In some embodiments, the composition may additionally comprise a surfactant (such as, for example, an anionic, nonionic and/or cationic surfactant), mixture of surfactants, or detergent-type aqueous solution. Nonlimiting examples of some suitable commercially available surfactants include Dynol 604 and Carbowet DC-01 (both available from Air Products & Chemicals, Inc., Allentown, Pa.), and Triton X-100 (available from The Dow Chemical Company, Midland Mich.). The surfactant, mixture of surfactants, or detergent-type aqueous solution may be present in the composition in an amount of 0.0003 wt % to 3 wt %, for example, 0.000375 wt % to 1 wt %, or 0.02 wt %. In one embodiment, the composition having a surfactant, mixture of surfactants, or detergent-type aqueous solution may be utilized to combine a metal substrate cleaning step and a conversion coating step in one process. In another embodiment, the composition having a surfactant, mixture of surfactants, or detergent-type aqueous solution can additionally contain an oxidizing agent, as previously described herein.

The composition may also contain other components and additives such as, but not limited to, carbonates, surfactants, chelators, thickeners, allantoin, polyvinylpyrrolidone, halides, and/or adhesion promoters. For example, in some embodiments, the composition may further comprise allantoin, polyvinylpyrrolidone, surfactants, and/or other additives and/or co-inhibitors.

In some embodiments, the composition may also contain an indicator compound, so named because they indicate, for example, the presence of a chemical species, such as a metal ion, the pH of a composition, and the like. An "indicator", "indicator compound", and like terms as used herein refer to a compound that changes color in response to some external stimulus, parameter, or condition, such as the presence of a metal ion, or in response to a specific pH or range of pHs.

The indicator compound used according to certain embodiments of the present invention can be any indicator known in the art that indicates the presence of a species, a particular pH, and the like. For example, a suitable indicator may be one that changes color after forming a metal ion complex with a particular metal ion. The metal ion indicator is generally a highly conjugated organic compound. A "conjugated compound" as used herein, and as will be understood by those skilled in the art, refers to a compound having two double bonds separated by a single bond, for example two carbon-carbon double bonds with a single carbon-carbon bond between them. Any conjugated compound can be used according to the present invention.

Similarly, the indicator compound can be one in which the color changes upon change of the pH; for example, the compound may be one color at an acidic or neutral pH and change color in an alkaline pH, or vice versa. Such indicators are well known and widely commercially available. An indicator that "changes color when exposed to an alkaline pH" therefore has a first color (or is colorless) when exposed to an acidic or neutral pH and changes to a second color (or goes from colorless to colored) when exposed to an alkaline pH. Similarly, an indicator that "changes color when exposed to an acidic pH" goes from a first color/colorless to a second color/colored when the pH changes from alkaline/neutral to acidic.

Nonlimiting examples of such indicator compounds include methyl orange, xylenol orange, catechol violet, bromophenol blue, green and purple, eriochrome black T, Celestine blue, hematoxylin, calmagite, gallocyanine, and combinations thereof. According to some embodiments, the indicator compound comprises an organic indicator compound that is a metal ion indicator. Nonlimiting examples of indicator compounds include those found in Table 1. Fluorescent indicators, which will emit light in certain conditions, can also be used according to the present invention, although in certain embodiments the use of a fluorescent indicator is specifically excluded. That is, in certain embodiments, conjugated compounds that exhibit fluorescence are specifically excluded. As used herein, "fluorescent indicator" and like terms refer to compounds, molecules, pigments, and/or dyes that will fluoresce or otherwise exhibit color upon exposure to ultraviolet or visible light. To "fluoresce" will be understood as emitting light following absorption of light or other electromagnetic radiation. Examples of such indicators, often referred to as "tags," include acridine, anthraquinone, coumarin, diphenylmethane, diphenylnaphthlymethane, quinoline, stilbene, triphenylmethane, anthracine and/or molecules containing any of these moieties and/or derivatives of any of these such as rhodamines, phenanthridines, oxazines, fluorones, cyanines and/or acridines.

TABLE 1

| Compound | Structure | CAS Reg. No. |
|---|---|---|
| Catechol Violet<br>Synonyms:<br>Catecholsulfonphthalein;<br>Pyrocatecholsulfonephthalein;<br>Pyrocatechol Violet | 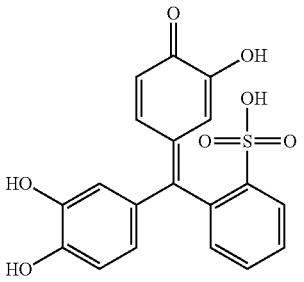 | 115-41-3 |

TABLE 1-continued

| Compound | Structure | CAS Reg. No. |
|---|---|---|
| Xylenol Orange<br>Synonym:<br>3,3'-Bis[N,N-bis(carboxymethyl)aminomethyl]-o-cresolsulfonephthalein tetrasodium salt | 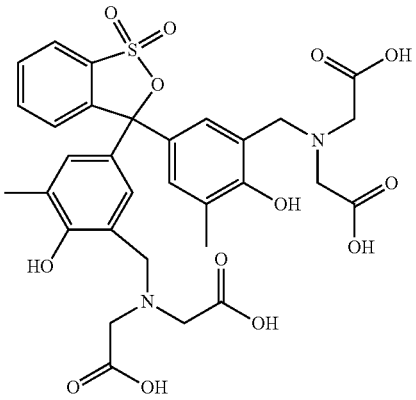 | 3618-43-7 |

According to one embodiment, the conjugated compound comprises catechol violet, as shown in Table 1. Catechol violet (CV) is a sulfone phthalein dye made from condensing two moles of pyrocatechol with one mole of o-sulfobenzoic acid anhydride. It has been found that CV has indicator properties and when incorporated into corrosion resistant compositions having metal ions, it forms complexes, making it useful as a chelometric reagent. As the composition containing the CV chelates metal ions, a generally blue to blue-violet color is observed.

According to another embodiment, xylenol orange, as shown in Table 1 is employed in the compositions according to embodiments of the present invention. It has been found that xylenol orange has metal ion indicator properties and when incorporated into corrosion resistant compositions having metal ions, it forms complexes, making it useful as a chelometric reagent. As the composition containing the xylenol orange chelates metal ions, a solution of xylenol orange turns from red to a generally blue color.

The indicator compound may be present in the composition in an amount of 0.01 g/1000 g solution to 3 g/1000 g solution, such as 0.05 g/1000 g solution to 0.3 g/1000 g solution.

In some embodiments of the present invention, the conjugated compound, if it changes color in response to a certain external stimulus, provides a benefit when using the current compositions, in that it can serve as a visual indication that a substrate has been treated with the composition. For example, a composition comprising an indicator that changes color when exposed to a metal ion that is present in the substrate will change color upon complexing with metal ions in that substrate; this allows the user to see that the substrate has been contacted with the composition. Similar benefits can be realized by depositing an alkaline or acid layer on a substrate and contacting the substrate with a composition of the present invention that changes color when exposed to an alkaline or acidic pH.

In addition, the use of certain conjugated compounds according to embodiments of the present invention can provide the substrate with improved adhesion to subsequently applied coating layers. This is particularly true if the conjugated compound has hydroxyl functionality. Accordingly, some embodiments of the present compositions allow for deposition of subsequent coating layers onto a substrate treated according to embodiments of the present invention without the need for a primer layer. Such coating layers can include urethane coatings and epoxy coatings.

The permanganate containing composition may have an alkaline, neutral or acidic pH. For example, in some embodiments, the permanganate containing composition may have a pH of 2 to 14. In some embodiments, for example, the permanganate composition may have a pH of 4 to 10.

In some embodiments, the permanganate containing composition may include 0.1 g to 60 g of a permanganate salt (e.g., K, Li, Na, etc.) and enough water to make 1 L of solution. According to some embodiments, for example, the permanganate composition may include 0.375 g to 7.5 g (e.g., 0.375 g to 2.5 g) of the permanganate salt, and enough water to make 1 L of solution.

In other embodiments, the permanganate containing composition may further include a transition element salt (e.g., a Zn, Zr, and/or Ti salt). In some exemplary embodiments, the permanganate containing composition may include 0.1 g to 60 g of the permanganate salt (e.g., K, Na, Li, etc.), 0.008 g to 10 g of the transition element salt, and enough water to make 1 L of solution. For example, in some embodiments, the permanganate-containing composition may include 0.375 g to 7.5 g (e.g., 0.375 g to 1.5 g) of the permanganate salt, 0.02 g to 0.04 g of the transition element salt, and enough water to make 1 L of solution.

In some embodiments, the permanganate containing composition may include a permanganate salt (e.g., K, Na, Li, etc.) and an oxidizer (e.g., a 30 wt % solution of a hydrogen peroxide). In some exemplary embodiments, the permanganate containing composition may include 0.1 g to 60 g of the permanganate salt, 0.08 g to 0.8 g of the oxidizer, and enough water to make 1 L of solution. For example, in some embodiments, the permanganate containing composition may include 0.375 g to 7.5 g (e.g., 0.375 g to 1.5 g) of the permanganate salt, 0.3 g to 0.5 g of the oxidizer, and enough water to make 1 L of solution.

In some embodiments, the permanganate containing composition may include a permanganate salt (e.g., K, Na, Li, etc.), a transition element salt (e.g., Zn, Zr and/or Ti), and an oxidizer (e.g., a 30 wt % solution of a hydrogen peroxide). In some embodiments, the permanganate containing composition may include 0.1 g to 60 g of the permanganate salt, 0.008 g to 10 g of the transition element salt, 0.08 g to 0.8 g of the oxidizer, and enough water to make 1 L of solution. For example, in some embodiments, the permanganate containing composition may include 0.375 g to 7.5 g (e.g., 0.375 g to 1.5 g) of the permanganate salt, 0.02 g to 0.04 g of the transition element salt, 0.3 g to 0.5 g of the oxidizer, and enough water to make 1 L of solution.

According to some embodiments, the permanganate composition may include an azole compound. In some embodiments, the permanganate composition may include 0.1 g to 60 g of the permanganate salt (e.g., K, Na, Li, etc.), 0.008 g to 2 g of the azole compound (e.g., 1H-benzotriazole), and enough water to make 1 L of solution. For example, in some embodiments, the permanganate composition may include 0.375 g to 7.5 g (e.g., 0.375 g to 1.5 g) of the permanganate salt, 0.02 g to 0.8 g of the azole compound, and enough water to make 1 L of solution.

In some embodiments, the permanganate composition may include a permanganate salt (e.g., K, Na, Li, etc.), a transition element salt (e.g., Zn, Zr, and/or Ti), and an azole compound (e.g., 1H-benzotriazole). In some embodiments, the permanganate composition may include 0.1 g to 60 g of the permanganate salt, 0.008 g to 10 g of the transition element salt, 0.008 g to 2 g of the azole compound, and enough water to make 1 L of solution. For example, in some embodiments, the permanganate containing composition may include 0.375 g to 7.5 g (e.g., 0.375 g to 1.5 g) of the permanganate salt, 0.02 g to 0.04 g of the transition element salt, 0.2 g to 0.8 g of the azole compound, and enough water to make 1 L of solution.

According to some embodiments, the permanganate containing composition may include a rare earth element salt. In some embodiments, the permanganate composition may include 0.1 g to 60 g of the permanganate salt (e.g., K, Ki, Na, etc.), 0.008 g to 10 g of the rare earth element salt (e.g., Ce, Y, Pr, etc.), and enough water to make 1 L of solution. For example, in some embodiments, the permanganate composition may include 0.375 g to 7.5 g (e.g., 0.375 g to 1.5 g) of the permanganate salt, 0.02 g to 0.04 g of the rare earth element salt, and enough water to make 1 L of solution.

Lithium Compositions

According to some embodiments of the present invention, a lithium containing composition for application to a metal substrate (e.g., a substrate comprising aluminum, magnesium, iron, zinc, nickel, and/or an alloy thereof) comprises a lithium source and a carrier.

The lithium source may comprise a lithium salt, a combination of lithium salts, or a combination of a lithium salt with additional Group IA or Group 1 element salts. The Group IA or Group 1 element salt may include any alkali metal (i.e., Group IA or Group 1) cation, such as, for example, Li, Na, K, Rb, Cs and/or Fr. In some embodiments, the alkali metal cation comprises Li, Na, K, Rb and/or Cs. For example, in some embodiments, the alkali metal cation comprises Na, K and/or Mg. Additionally, although the "lithium source" is described here as including a Li ion, Mg may be substituted for all or a part of the Li in the lithium source.

The lithium salt and/or Group IA or Group 1 element salts may include any suitable anion capable of forming a salt with the Group IA or Group 1 elements and Mg (e.g., Li, Mg, Na, K, Rb, Cs and/or Fr). Nonlimiting examples of anions suitable for forming a salt with these elements include carbonates, hydroxides, nitrates, halides (e.g., $Cl^-$, $Br^-$, $I^-$ or $F^-$), sulfates, phosphates and silicates (e.g., orthosilicates and metasilicates). For example, the metal salt may comprise a carbonate, hydroxide, halide, nitrate, sulfate, phosphate and/or silicate (e.g., orthosilicate or metasilicate) of Li, Na, K, Rb, Cs, Fr and/or Mg. In some embodiments for example, the metal salt may comprise a carbonate, hydroxide, halide, nitrate, sulfate, phosphate and/or silicate (e.g., orthosilicate or metasilicate) of Li, Mg, Na, K, Rb and/or Cs. In some embodiments, for example, the metal salt may comprise a hydroxide, halide and/or phosphate of Li, Na, K, Rb, Cs, Fr and/or Mg. For example, in some embodiments, the metal salt may comprise a hydroxide, halide and/or phosphate of Li, Na, K and/or Mg. In some embodiments, for example, the metal salt may comprise a hydroxide, halide and/or phosphate of Li, Na and/or K.

In some embodiments, the concentration of lithium ions in the lithium containing composition may be 0.02 g to 12 g per 1000 g of solution. For example, the lithium concentration in the composition may be 1 g to 2 g per 1000 g of solution. Additionally, when other Group IA or Group 1 ions (e.g., sodium and/or potassium ions) are present, the concentration of those ions in the lithium containing composition may be, for example, 0.2 g to 16 g per 1000 g of solution.

Additionally, in some embodiments, the composition may include at least two metal salts, and the at least two metal salts may comprise different anions and/or cations from each other. For example, the at least two metal salts may comprise different anions but the same cations, or may comprise different cations but the same anions. In some embodiments, for example, the lithium containing composition may include the same cation but at least two different anions. For example, in some embodiments, the lithium containing composition may include a hydroxide ion, and a phosphate and/or halide ion.

In some exemplary embodiments, the lithium containing composition may include 0.09 g to about 16 g hydroxide ions per 1000 g solution. In some embodiments, the lithium containing composition may include 0.2 g to 16 g phosphate ions (e.g., phosphate ions ($PO_4^{3-}$), di-hydrogen phosphate ions ($H_2PO_4^-$), and/or pyrophosphate ions ($P_2O_7^{4-}$), or organic phosphates, such as those offered under the name Dequest, available from Monsanto (St. Louis, Mo.)) per 1000 g solution. In some embodiments, the lithium containing composition may include 0.2 g to 1.5 g halide ions (e.g., F ions, which may be present in solution as NaF, for example) per 1000 g solution. In some embodiments, the lithium containing composition may include hydroxide ions and either halide ions or phosphate ions, and in other embodiments, the lithium containing composition may include hydroxide ions, halide ions and phosphate ions. In some embodiments, the lithium containing composition may also include carbonate ions, for example 0.05 g to 12 g carbonate ions per 1000 g of solution, or 1 g to 2 g carbonate ions per 1000 g of solution.

Additionally, in some embodiments the lithium composition may include Li and another Group IA or Group 1 element, such as, for example, Na. In some embodiments, for example, the metal cation is provided in the composition in the form of a metal salt such as a Li salt, a Mg salt, a Na salt, a K salt, a Rb salt and/or a Cs salt. In some embodiments, the lithium containing solution is alkaline. For example, in some embodiments, the lithium containing composition may include a combination of lithium hydroxide and sodium pyrophosphate in an aqueous solution.

Additionally, in some embodiments, the lithium containing composition may include a transition element source. The transition element source may include a transition element, as that term is defined above, and an anion. The anion in the transition element source may be an anion as described above with respect to the metal salts in the permanganate containing composition, or an anion as described above with the respect to the lithium source in the lithium containing composition. For example, in some embodiments, the transition element source may include zinc, zirconium or the like as the transition element, and phosphate as the anion. For example, in some embodiments, the lithium containing composition includes 0.1 to 5 g per 4 liters (or 0.025 to 1.25 g per 1 L), e.g., 1 g per 4 liters (or 0.25 g per 1 L), of the transition element source, e.g., Zn phosphate. In some embodiments, for example, embodiments including Zn, the lithium containing composition may include lower amounts of the transition element source, e.g., 0.08 g per 1 L.

In some embodiments, the lithium containing composition may be substantially free of transition metals, chromates, other metallates and oxidizing agents. For example in some embodiments, the lithium containing composition may be substantially free of metals other than Group IA or Group 1 metals, and in other embodiments, the lithium containing composition may be substantially free of metals other than Group IA or Group 1 metals and Mg. As used herein, the term "substantially" is used as a term of approximation, and not as a term of degree. Accordingly, the term "substantially free," as used herein denotes that the amount of the metals (e.g., transition metals) in the composition is negligible, such that if such metals are present in the composition at all, it is as an incidental impurity.

In some embodiments, the composition may be an aqueous coating composition, and the composition may therefore further include an aqueous carrier which may optionally comprise one or more organic solvents. Nonlimiting examples of suitable such solvents include propylene glycol, ethylene glycol, glycerol, low molecular weight alcohols, and the like. When used, the organic solvent may be present in the composition in an amount of 1 g to 20 g solvent per liter of composition with the remainder of the carrier being water. For example, in some embodiments, the organic solvent may be present in the composition in an amount of 8.33 g solvent per liter of composition with the remainder of the carrier being water. In some embodiments, for instance, the organic solvent may be present in the composition in an amount of 30 g to 400 g solvent per 12 liters of composition, with the remainder of the carrier being water. For example, in some embodiments, the organic solvent may be present in the composition in an amount of 100 g to 200 g solvent per 12 liters of composition, for example 107 g solvent per 12 liters of composition, with the remainder of the carrier being water. In some embodiments, however, the aqueous carrier is primarily water, e.g., deionized water. The aqueous carrier is provided in an amount sufficient to provide the composition with the concentrations of the metal ions and anions described herein.

The concentration of the lithium source in the composition may be any amount suitable to provide the concentrations of the anions discussed above. For example, in some embodiments, the concentration of the lithium source in the composition may be 0.008 percent by weight up to the solubility limit of the lithium source in the carrier. In some embodiments, for example, the lithium source may be present in the composition in a concentration of 1 g to 2 g per 1000 g of the composition. In some embodiments, the lithium source may be present in the composition in a concentration of 0.05 g to 12 g per 1000 g of the composition.

In some embodiments of the present invention, the lithium containing composition may further comprise one or more additives for promoting corrosion resistance, adhesion to the metal substrate, adhesion of subsequent coatings, and/or to provide another desired aesthetic or functional effect. An additive, if used, may be present in the composition in an amount of 0.01 weight percent up to 80 weight percent based on the total weight of the composition. For example, in some embodiments, the additive (e.g., a surfactant) may be present in the lithium containing composition at a concentration of 0.015 g to 5 g per 1000 g of solution. In some embodiments, the additive (e.g., a surfactant and/or polyvinylpyrrolidone) may be present in the lithium containing composition at a concentration of 0.15 g to 1 g per 1000 g of solution.

Suitable additives may include a solid or liquid component admixed with the composition for the purpose of affecting one or more properties of the composition. The additive may include, for example, an azole compound (such as those described above with respect to the permanganate containing composition), a surfactant, which can assist in wetting the metal substrate, and/or other additives that can assist in the development of a particular surface property, such as a rough or smooth surface. Other nonlimiting examples of suitable additives include alcohols, co-inhibitors, lithium salts, flow control agents, thixotropic agents such as bentonite clay, gelatins, cellulose, anti-gassing agents, degreasing agents, anti-foaming agents, organic co-solvents, catalysts, dyes, amino acids, urea based compounds, complexing agents, valence stabilizers, and the like, as well as other customary auxiliaries. Suitable additives are known in the art of formulating compositions for surface coatings and can be used in the compositions according to embodiments of the present invention, as would be understood by those of ordinary skill in the art with reference to this disclosure.

As discussed above, in some embodiments, the lithium containing composition may additionally comprise a surfactant (such as, for example, an anionic, nonionic and/or cationic surfactant), mixture of surfactants, or detergent-type aqueous solution. Nonlimiting examples of some suitable commercially available surfactants include Dynol 604 and Carbowet DC-01 (both available from Air Products & Chemicals, Inc., Allentown, Pa.), and Triton X-100 (available from The Dow Chemical Company, Midland Mich.). The surfactant, mixture of surfactants, or detergent-type aqueous solution may be present in the composition in an amount of 0.015 g to 5 g per 1000 g of solution. For example, the surfactant, mixture of surfactants, or detergent-type aqueous solution may be present in the composition in an amount of 0.015 g to 1 g per 1000 g of solution. In one embodiment, the composition having a surfactant, mixture of surfactants, or detergent-type aqueous solution may be utilized to combine a metal substrate cleaning step and a conversion coating step in one process.

As also discussed above, the lithium containing composition may also contain other components and additives such as, but not limited to, carbonates, surfactants, chelators, thickeners, allantoin, polyvinylpyrrolidone, halides, azole compounds (such as those described above, for example, 2,5-dimercapto-1,3,4-thiadiazole) and/or adhesion promoters. For example, in some embodiments, the composition may further comprise allantoin, polyvinylpyrrolidone, surfactants, and/or other additives and/or co-inhibitors.

In some embodiments, the lithium containing composition may further include an indicator compound, such as those described above with respect to the permanganate containing compound. The indicator compound may be present in the composition in an amount of from about 0.0001 to 3 g per liter of composition. For example, in some embodiments, the indicator compound may be present in the composition in an amount of 0.0001 g to 1 g per liter of composition. In some embodiments, for example, the indicator compound may be present in the composition in an amount of 0.082 g to 0.0132 g per liter of composition.

For example, in some embodiments of the present invention, the lithium containing composition may include an aqueous solution including lithium hydroxide (LiOH), lithium di-hydrogen phosphate ($LiH_2PO_4$), and a surfactant. In another example embodiments, the lithium containing composition may include an aqueous solution including lithium hydroxide (LiOH), sodium phosphate or pyrophosphate ($Na_3PO_4$ or $Na_4P_2O_7$), and a surfactant.

In yet another example embodiment, the lithium containing composition may include an alkaline aqueous carrier, a lithium ion, another Group IA or Group 1 element ion, a carbonate ion, a hydroxide ion, a phosphate ion, and optionally an additive (e.g., a surfactant, a chelator, a thickener, allantoin, polyvinylpyrrolidone, 2,5-dimercaptor-1,3,4-thiadiazole, a halide (e.g., F), an adhesion promoting silane, and/or an alcohol). For example, in some embodiments, the lithium containing composition may include an aqueous solution including lithium carbonate ($Li_2CO_3$), sodium hydroxide (NaOH), sodium phosphate ($Na_3PO_4$), a surfactant, and optionally polyvinylpyrrolidone.

In another example embodiment, the lithium containing composition may include an alkaline aqueous carrier, a lithium ion, a hydroxide ion, a halide ion (e.g., F), and optionally an additive (e.g., a carbonate, a surfactant, a chelator, a thickener, allantoin, polyvinylpyrrolidone, 2,5-dimercaptor-1,3,4-thiadiazole, a halide (e.g., F), an adhesion promoting silane, and/or an alcohol). For example, in some embodiments, the lithium containing composition may include an aqueous solution including lithium hydroxide (LiOH), sodium fluoride (NaF), and a surfactant.

In some embodiments, the lithium containing composition may include 0.05 g to 12 g of $Li_2CO_3$, and enough water to make 1 L of composition. For example, in some embodiments, the lithium containing composition may include 1 g to 2 g of $Li_2CO_3$, and enough water to make 1 L of composition.

According to some embodiments, the lithium containing composition may include 0.05 g to 12 g $Li_2CO_3$, 1 g to 20 g ethanol, and enough water to make 1 L of composition. For example, in some embodiments, the lithium containing composition may include 1 g to 2 g of $Li_2CO_3$, 8.33 g of ethanol, and enough water to make 1 L of composition.

In some embodiments, the lithium containing composition may include 0.05 g to 12 g of $Li_2CO_3$, 0.0001 g to 1 g of an indicator compound, and enough water to make 1 L of composition. For example, in some embodiments, the lithium containing composition may include 1 g to 2 g of $Li_2CO_3$, 0.082 g to 0.0132 g of an indicator compound, and enough water to make 1 L of composition.

As discussed above, in some embodiments, the lithium containing composition may be alkaline, i.e., have a pH above 7. For example, in some embodiments, the lithium composition can have a pH above 10. Additionally, in some embodiments, the temperature of the composition, when applied to a substrate, may be 15° C. to 120° C., for example 15° C. to 25° C. (or room temperature).

The lithium-containing compositions described herein can be used in conjunction with the permanganate-containing compositions to coat metal substrates in order to inhibit corrosion. For example, the metal substrate may first be coated or treated with the permanganate containing compositions, and then coated or treated with the lithium containing compound. Embodiments of methods for coating a metal substrate are described in more detail below.

Substrates

According to another embodiment of the invention, a metal substrate (e.g., an aluminum or aluminum alloy substrate) may comprise a surface that is contacted with the permanganate containing composition and/or the lithium containing composition according to embodiments of the invention. Nonlimiting examples of suitable substrates include aluminum, zinc, iron, and/or magnesium substrates. Additional nonlimiting examples of suitable metal substrates include high copper containing aluminum alloys such as Aluminum 2024.

According to some embodiments, the metal substrate may be pre-treated prior to contacting the metal substrate with the permanganate-containing composition and/or lithium containing composition described above. As used herein, the term "pre-treating" refers to the surface modification of the substrate prior to subsequent processing. Such surface modification can include various operations, including, but not limited to cleaning (to remove impurities and/or dirt from the surface), deoxidizing, and/or application of a solution or coating, as is known in the art. Pre-treatment may have one or more benefits, such as the generation of a more uniform starting metal surface, improved adhesion to a subsequent coating on the pre-treated substrate, and/or modification of the starting surface in such a way as to facilitate the deposition of a subsequent composition.

According to some embodiments, the metal substrate may be prepared by first solvent treating the metal substrate prior to contacting the metal substrate with the permanganate containing composition and/or lithium containing composition. As used herein, the term "solvent treating" refers to rinsing, wiping, spraying, or immersing the substrate in a solvent that assists in the removal of inks, oils, etc. that may be on the metal surface. Alternately, the metal substrate may be prepared by degreasing the metal substrate using conventional degreasing methods prior to contacting the metal substrate with the permanganate containing composition and/or lithium containing composition.

The metal substrate may be pre-treated by solvent treating the metal substrate. Then, the metal substrate may be pre-treated by cleaning the metal substrate with an alkaline cleaner or degreaser. Some nonlimiting examples of suitable alkaline cleaners/degreasers include the "DFM Series" line of products available from PRC-DeSoto International, Inc., Sylmar, Calif. These products are alkaline etching or degreasing agents, and some exemplary products include DFM4 and DFM10 (both manufactured by PRC-DeSoto International, Inc., Sylmar, Calif.). Other nonlimiting examples of suitable degreasing compositions include RECC 1001 and 88X002 (both manufactured by PRC-DeSoto International, Inc., Sylmar, Calif.).

The metal substrate can optionally be deoxidized after the substrate is degreased. Alternatively, the metal substrate need not be degreased, but may be deoxidized before the application of the permanganate-containing composition and/or the lithium containing composition. An exemplary deoxidizing composition can comprise an acid (e.g., nitric acid), a chelator, and a carrier. In one embodiment, the chelator can comprise ascorbic acid. In another embodiment, a phosphoric acid/isopropyl alcohol acidic deoxidizer may be used.

In some embodiments, a degreaser/deoxidizer composition may include 0.5 g to 5 g of NaOH, 0.5 g to 20 g of sodium phosphate, 0.001 g to 5 g of polyvinylpyrrolidone, 0.001 to 5 g of allantoin, 0.05 to 10 g of 1-[2-(dimethylamino)ethyl]-1H-tetrazole-5-thiol (DMTZ), 0.01 g to 20 g of Carbowet® DC01 Surfactant from Air Products, and enough water to make 1 L of solution. In another embodiment, a degreaser/deoxidizer composition may include 0.5 to 20 g of potassium hydroxide, 0.05 to 10 g of potassium polyphosphate, 0.5 to 25 g of potassium silicate, 0.5 to 20 g of DCOI, and enough water to make 1 L of solution. In still another embodiment, a degreaser/deoxidizer composition may include 0.5 to 20 g of sodium hydroxide, 0.05 to 20 g of sodium phosphate, 0.0005 to 5 g of Start Right® (a water conditioner available from United Pet Group, Inc., Madison, Wis.), 0.5 to 20 g of Carbowet® DC01 Surfactant from Air Products, and enough water to make 1 L of solution. According to some embodiments, a degreaser/deoxidizer composition may include 50 to 500 mL of butanol, 50 to 500 mL of isopropanol, 0.01 to 5 mL of phosphoric acid, and enough water to make 1 L of solution. In some embodiments, for example, a degreaser/deoxidizer composition may include 0.05 to 5 g of ascorbic acid, 5 to 200 mL of nitric acid, and enough water to make 1 L of solution. One nonlimiting example of a suitable degreaser/deoxidizer composition is Deft Clean 4000 available from PRC-DeSoto International, Inc., Sylmar, Calif.

In one embodiment, the metal substrate can be treated with an oxide forming agent prior to treatment with the permanganate-containing composition and/or lithium containing composition. Exemplary oxide forming agents can comprise lithium and/or aluminum salts. In some embodiments, the oxide forming agent treatment can comprise immersion of the metal substrate in boiling water.

In some embodiments, the metal substrate may be pretreated by mechanically deoxidizing the metal prior to applying the composition on the metal substrate. A nonlimiting example of a typical mechanical deoxidizer is uniform roughening of the surface using a Scotch-Brite pad, or similar device.

According to some embodiments, the metal substrate may be pre-treated by solvent wiping the metal prior to applying the permanganate containing composition and/or the lithium containing composition to the metal substrate. Nonlimiting examples of suitable solvents include methyl ethyl ketone (MEK), methyl propyl ketone (MPK), acetone, and the like.

Additional optional procedures for preparing the metal substrate include the use of a surface brightener, such as an acid pickle or light acid etch, or a smut remover.

The metal substrate may be rinsed with either tap water, or distilled/de-ionized water between each of the pretreatment steps, and may be rinsed well with distilled/de-ionized water and/or alcohol after contact with the permanganate containing composition and/or lithium containing composition according to embodiments of the present invention. However, according to some embodiments of the present invention, some of the above described pre-treatment procedures and rinses may not be necessary prior to or after application of the composition according to embodiments of the present invention. For example, in some embodiments, the metal substrate may be treated with a degreaser and then rinsed. In other embodiments, the metal substrate may be treated with a deoxidizer (e.g., an acidic deoxidizer) and then rinsed. In still other embodiments, the metal substrate may be treated with a degreaser and then rinsed, and then treated with a deoxidizer and then rinsed. Additionally, this cleaning process may be performed in one combined process, or may be performed in multiple processes. For example, in some embodiments, the metal substrate may be treated with an alkaline degreaser followed by a rinse, and then followed by treatment with an acidic deoxidizer prior to treatment with the permanganate containing composition and/or lithium containing composition described above.

According to another embodiment of the present invention, the metal substrate may be treated with an acidic deoxidizer comprising an acid (e.g., nitric acid) and a metal chelator prior to treatment with the permanganate-containing composition. An example of the metal chelator is Vitamin C In some embodiments, for example, the acidic deoxidizer may include 10 g to 500 g of an acid (e.g., nitric acid), 0.1 g to 15 g of a chelator (e.g., ascorbic acid), and enough water to make 1 L of solution. For example, in some embodiments, the acidic deoxidizer may include 70 g to 200 g of an acid, 0.5 g to 3 g of a chelator, and enough water to make 1 L of solution.

Once the metal substrate has been appropriately pretreated, if desired, the permanganate containing composition according to embodiments of the present invention may then be allowed to come in contact with at least a portion of the surface of the metal substrate. The metal substrate may be contacted with the composition using any conventional technique, such as dip immersion, spraying, or spreading using a brush, roller, or the like. With regard to application via spraying, conventional (automatic or manual) spray techniques and equipment used for air spraying may be used. In other embodiments, the composition may be applied using an electrolytic-coating system.

After contacting the metal substrate with the permanganate containing composition, the metal substrate may optionally be air dried. However, the substrate need not be dried, and in some embodiments, drying is omitted. A rinse is also not required, but may be performed if desired.

According to some embodiments, the metal substrate may be first prepared by mechanical abrasion and then wet-wiped to remove smut. The substrate may then optionally be air-dried prior to application. However, the substrate need not be dried, and in some embodiments, drying is omitted. Next, the permanganate containing composition may be applied to the metal substrate and optionally allowed to dry, for example in the absence of heat greater than room temperature. However, drying is not required, and in some embodiments, drying is omitted. The substrate need not be rinsed, and the metal substrate may then be further coated with the lithium containing compositions described above, conversion coatings, primers and/or top coats to achieve a substrate with a finished coating.

When the composition is applied to the metal substrate by immersion, the immersion times may vary from a few seconds to multiple hours, for example less than 30 minutes or three minutes or less. In some embodiments, for example, the immersion time may be 2 to 10 minutes or 2 to 5 minutes. When the composition is applied to the metal substrate using a spray application, the composition may be brought into contact with at least a portion of the substrate using conventional spray application methods. The dwell time in which the composition remains in contact with the metal substrate may vary from a few seconds to multiple hours, for example less than 30 minutes or three minutes or less. For example, in some embodiments, the dwell time may be 2 to 10 minutes or 2 to 5 minutes. As discussed above, the permanganate containing composition may have a pH of 2 to 14, for example 4 to 10.

The permanganate containing compositions may also be applied using other techniques known in the art, such as application via swabbing. Again, the dwell time in which the composition remains in contact with the metal substrate may vary from a few seconds to multiple hours, for example less than 30 minutes or three minutes or less. For example, in some embodiments, the dwell time may be 2 to 10 minutes or 2 to 5 minutes.

After contacting the metal substrate with the permanganate containing composition, the metal substrate may optionally be air dried, and then rinsed with tap water, or distilled/de-ionized water. Alternately, after contacting the metal substrate with the permanganate containing composition, the metal substrate may be rinsed with tap water, or distilled/de-ionized water, and then subsequently air dried (if desired). However, the substrate need not be dried, and in some embodiments, drying is omitted. Additionally, as noted above, the substrate need not be rinsed, and the metal substrate may then be further coated with the lithium containing composition described above, conversion coatings, primers and/or top coats to achieve a substrate with a finished coating. Accordingly, in some embodiments this subsequent rinse may be omitted.

In some embodiments, the permanganate containing composition according to embodiments of the invention may be applied to the metal substrate for 1 to 10 minutes (for example, 2 to 5 minutes), and the surface of the metal substrate may be kept wet by reapplying the composition. Then, the composition is optionally allowed to dry, for example in the absence of heat greater than room temperature, for 5 to 10 minutes (for example, 7 minutes) after the last application of the composition. However, the substrate does not need to be allowed to dry, and in some embodiments, drying is omitted. For example, according to some embodiments, a solvent (e.g., alcohol) may be used to rinse the substrate, which allows the omission of a drying step. Alternatively, the metal substrate may be rinsed with deionized water (e.g., for 2 minutes) and optionally allowed to dry.

After the drying step (if performed), the metal substrate may be contacted with the lithium containing composition described above for 2 to 10 minutes, for example 2 to 3 minutes. In some embodiments, for example, the lithium composition includes the lithium source, the carrier, and an azole compound. By treating the metal substrate first with a permanganate-containing composition, followed by application of the lithium containing composition including an azole compound, the result is a favorable reaction on the substrate of the metal permanganate treated substrate. The lithium containing composition may then be dried on the substrate (if desired), or can optionally be rinsed from the substrate.

After the drying step (if performed) after application of the lithium containing composition, the metal substrate may be coated with a conversion coating, e.g., a rare earth conversion coating, such as a cerium or yttrium based conversion coating. Examples of such coatings include those having cerium and/or yttrium salts. In addition to rare earth coatings, any suitable conversion coating chemistry may be used, such as, for example, those that are capable of forming a precipitate upon a change in pH. Nonlimiting examples of such coating chemistries include trivalent chrome, such as Alodine 5900 (available from Henkel Technologies, Madison Heights, Mich.), zirconium, such as Alodine 5900 (available from Henkel Technologies, Madison Heights, Mich.), sol gel coatings, such as those sold under the name DesoGel™ (available from PRC-DeSoto International, Inc. of Sylmar, Calif.), cobalt coatings, vanadate coatings, molybdate coatings, permanganate coatings, and the like, as well as combinations, such as, but not limited to Y and Zr. The conversion coating (e.g., a rare earth conversion coating) may be applied to the metal substrate for 5 minutes. The substrate need not be rinsed, and the metal substrate may then be further coated with primers and/or top coats to achieve a substrate with a finished coating.

According to some embodiments, a method of treating a substrate includes cleaning the substrate by applying a cleaning composition to the substrate. The cleaning composition may be either acidic or alkaline. In some embodiments, for example, cleaning the substrate may include applying an acidic cleaning composition to the substrate, and/or applying an alkaline cleaning composition to the substrate. The acidic cleaning composition may include, for example, an acidic deoxidizer, such as those described above. Additionally, the alkaline cleaning composition may include, for example, an alkaline degreaser, such as those described above. The acidic and/or alkaline cleaning composition may be applied to the substrate for the times and under the conditions described above with respect to the deoxidizers and degreasers.

The method may further include rinsing the substrate after cleaning with the acidic composition and/or the alkaline composition. A single rinse may be performed, or multiple rinses may be performed. For example, in some embodiments, two rinses may be performed. Each rinse may include, for example, a rinse with deionized water.

Additionally, the method may include applying a first composition comprising a permanganate source and a first carrier to the cleaned substrate. The first composition may include the permanganate source and carrier in the amounts and concentrations discussed above with respect to the permanganate containing composition. Also, the first composition may include the permanganate compositions described above. However, the first composition need not include all the components described above with respect to the permanganate containing composition. For example, in some embodiments, the first composition includes the permanganate source and the carrier, but does not include an additional metal salt as a corrosion inhibitor. Indeed, in some embodiments, the first composition "consists of" or "consists essentially of" the permanganate source and the carrier. As used herein, the term "consists of" is used to exclude all unlisted components except for normal, or naturally occurring impurities, and the term "consists essentially of" is used to exclude all unlisted components that do not materially affect the performance of the first composition. For example, in some embodiments, the term "consists essentially of" in connection with the first composition excludes components such as additional metal salts (i.e., other than the permanganate source), azole compounds, and other additives. The first composition may be applied to the substrate for the times and under the conditions described above with respect to the permanganate containing composition.

The method may also include rinsing the substrate after application of the first composition. A single rinse may be performed, or multiple rinses may be performed. For example, in some embodiments, two rinses may be performed. Each rinse may include, for example, a rinse with deionized water.

In addition, the method may include applying a second composition comprising a lithium source and a second carrier to the permanganate treated substrate. The second composition may include the lithium source and the second carrier in the amounts and concentrations discussed above with respect to the lithium containing composition. Also, the second composition may include the lithium containing compositions described above. For example, in some embodiments, the second composition may include the lithium source, the second carrier, and an indicator compound (e.g., catechol violet) and/or an azole compound (e.g., 2,5-dimercapto-1,3,4-thiadiazole, 1H-benzotriazole, 1H-1,2,3-triazole, 2-amino-5-mercapto-1,3,4-thiadiazole, and/or 2-amino-1,3,4-thiadiazole). When included in the second composition, the indicator compound and/or azole compound may be present in the amounts and concentrations described above with respect to those components in the lithium containing composition.

The following examples are presented for illustrative purposes only and do not limit the scope of the present invention.

Example 1—Permanganate Containing Composition

A solution (Soln 0) was prepared by mixing 4.5 g of potassium permanganate ($KMnO_4$) in enough deionized water to make 12 liters.

Example 2—Permanganate Containing Composition

A solution (Soln 1) was prepared by mixing 4.5 g of potassium permanganate ($KMnO_4$) and 0.5 g of cerium nitrate ($Ce(NO_3)_3$) in enough deionized water to make 12 liters.

Example 3—Permanganate Containing Composition

A solution (Soln 2) was prepared by mixing 4.5 g of potassium permanganate ($KMnO_4$) and 0.5 g of 1H-benzotriazole (BTA) in enough deionized water to make 12 liters.

Example 4—Permanganate Containing Composition

A solution (Soln 3) was prepared by mixing 4.5 g of potassium permanganate ($KMnO_4$) and 0.5 g of hydrogen peroxide ($H_2O_2$) in enough deionized water to make 12 liters.

Example 5—Permanganate Containing Composition

A solution (Soln 4) was prepared by mixing 30 g of potassium permanganate ($KMnO_4$) in enough deionized water to make 12 liters.

Example 6—Lithium Containing Composition

A solution (SIB) was prepared by mixing 12 g of lithium carbonate ($Li_2CO_3$) in enough deionized water to make 12 liters.

Example 7—Lithium Containing Composition

A solution (SIB-CV) was prepared by mixing 4.5 g of lithium carbonate ($Li_2CO_3$), and 0.158 g of catechol violet in enough deionized water to make 12 liters.

Example 8—Lithium Containing Composition

A solution (SIC) was prepared by mixing 18.4 g of lithium carbonate ($Li_2CO_3$) in enough deionized water to make 12 liters.

Example 9—Lithium Containing Composition

A solution (SIC-BTA) was prepared by mixing 18.4 g of lithium carbonate ($Li_2CO_3$), and 1 g of 1H-benzotriazole (BTA) in enough deionized water to make 12 liters.

Example 10—Lithium Containing Composition

A solution (SIC-CV) was prepared by mixing 18.4 g of lithium carbonate ($Li_2CO_3$), and 0.158 g of catechol violet in enough deionized water to make 12 liters.

Example 11—Lithium Containing Composition

A solution (S2B) was prepared by mixing 12 g of lithium carbonate ($Li_2CO_3$), and 100 g of ethanol in enough deionized water to make 12 liters.

Example 12—Lithium Containing Composition

A solution (S2C) was prepared by mixing 18.4 g of lithium carbonate ($Li_2CO_3$), and 100 g of ethanol in enough deionized water to make 12 liters.

The compositions prepared according to Examples 1 through 12 were coated on aluminum panels and tested. In particular, triplicate panels (panels A, B and C) of Bare A12024-T3 (available from Continental Steel & Tube Company, Fort Lauderdale, Fla.) were treated in the manner set forth below and shown in the following Table 1. The panels were treated at room temperature, i.e., approximately 25° C. The abbreviations for the compositions in Table 1 are found in the descriptions of the Examples above.

First, a de-greaser was applied to the panels for 3.5 minutes. The degreaser used was either DFM 4 (panels 1-4), RECC 1001 (panels 5-8), 88X002 (panels 9-12 and 21), or DFM 10 (panels 13-20), all of which degreasers are available from PRC-DeSoto International, Inc., Sylmar, Calif. After application of the degreaser, each panel was rinsed twice with deionized water for 2 minutes per rinse. Then, the permanganate-containing composition indicated in the Table (i.e., Soln 0, Soln 1, Soln 2, Soln 3 or Soln 4) or RECC 3070 (a rare earth conversion coating composition available from PRC-DeSoto International, Inc., Sylmar, Calif.) was applied to each panel for 2 minutes or 5 minutes (as indicated in the Table).

Each of the panels was then rinsed with deionized water for 2 minutes. Following the rinse, the lithium-containing composition indicated in the Table (i.e., SIB, SIB-CV, SIC, SIC-BTA, SIC-CV, S2B or S2C) was applied to each of the panels for 2 minutes.

After treatment, the performance of each of the treated panels was measured by a 4 day neutral salt spray test run in accordance with ASTM B 117. The test panels were rated according to the ELM Scale, which has the following rating parameters:

10 Substantially identical to how it went into test
9 Passes MIL-C-5541 with less than or equal to 3 pits (with or without tails) per 3"×6" panel
8 Passes MIL-C-5541 with less than or equal to 3 pits with white corrosion tails (Discoloring tails okay) per 3"×6" panel
7 >3 pits with tails, but not more than 15 pits total
6 >15 pits total but <40 pits total
5 30% of substrate is corroded
4 50% of substrate is corroded
3 70% of substrate is corroded
2 85% of substrate is corroded
1 100% of substrate is corroded The ELM rating for each panel, reported as an average rating of the triplicate panels (A-C) for each listed panel, is shown in Table 2, below.

TABLE 2

| Panels A-C | App I Degrease | Time I | App II Rinse | Time II | App III Permanganate | Time III | App IV Rinse | Time IV | App V Lithium | Time V | ELM 4 day salt spray |
|---|---|---|---|---|---|---|---|---|---|---|---|
| 1 | DFM4 | 3.5 m | Rinse × 2 | 2 m | Soln 0 | 2 m | Rinse | 2 m | SIC | 2 m | 9 |
| 2 | DFM4 | 3.5 m | Rinse × 2 | 2 m | Soln 1 | 2 m | Rinse | 2 m | SIC | 2 m | 10 |
| 3 | DFM4 | 3.5 m | Rinse × 2 | 2 m | Soln 2 | 2 m | Rinse | 2 m | SIC | 2 m | 8 |
| 4 | DFM4 | 3.5 m | Rinse × 2 | 2 m | Soln 3 | 2 m | Rinse | 2 m | SIC | 2 m | 9 |
| 5 | RECC 1001 | 3.5 m | Rinse × 2 | 2 m | Soln 0 | 2 m | Rinse | 2 m | SIC | 2 m | 9 |
| 6 | RECC 1001 | 3.5 m | Rinse × 2 | 2 m | Soln 1 | 2 m | Rinse | 2 m | SIC | 2 m | 9 |
| 7 | RECC 1001 | 3.5 m | Rinse × 2 | 2 m | Soln 2 | 2 m | Rinse | 2 m | SIC | 2 m | 8 |
| 8 | RECC 1001 | 3.5 m | Rinse × 2 | 2 m | Soln 3 | 2 m | Rinse | 2 m | SIC | 2 m | 9 |
| 9 | 88X002 | 3.5 m | Rinse × 2 | 2 m | Soln 0 | 2 m | Rinse | 2 m | SIC | 2 m | 8 |
| 10 | 88X002 | 3.5 m | Rinse × 2 | 2 m | Soln 1 | 2 m | Rinse | 2 m | SIC | 2 m | 8 |
| 11 | 88X002 | 3.5 m | Rinse × 2 | 2 m | Soln 2 | 2 m | Rinse | 2 m | SIC | 2 m | 8 |
| 12 | 88X002 | 3.5 m | Rinse × 2 | 2 m | Soln 3 | 2 m | Rinse | 2 m | SIC | 2 m | 8 |
| 13 | DFM10 | 3.5 m | Rinse × 2 | 2 m | Soln 0 | 2 m | Rinse | 2 m | SIC | 2 m | 9 |
| 14 | DFM10 | 3.5 m | Rinse × 2 | 2 m | Soln 1 | 2 m | Rinse | 2 m | SIC | 2 m | 9 |
| 15 | DFM10 | 3.5 m | Rinse × 2 | 2 m | Soln 2 | 2 m | Rinse | 2 m | SIC | 2 m | 8 |
| 16 | DFM10 | 3.5 m | Rinse × 2 | 2 m | Soln 3 | 2 m | Rinse | 2 m | SIC | 2 m | 9 |
| 17 | DFM10 | 3.5 m | Rinse × 2 | 2 m | 3070 | 5 m | Rinse | 2 m | SIC | 2 m | 9 |
| 18 | DFM10 | 3.5 m | Rinse × 2 | 2 m | 3070 | 5 m | Rinse | 2 m | SIC-BTA | 3 m | 10 |
| 19 | DFM10 | 3.5 m | Rinse × 2 | 2 m | 3070 | 5 m | Rinse | 2 m | SIC-CV | 2 m | 10 |
| 20 | DFM10 | 3.5 m | Rinse × 2 | 2 m | 3070 | 5 m | Rinse | 2 m | S2C | 2 m | 10 |
| 21 | 88X002 | 3.5 m | Rinse × 2 | 2 m | Soln 4 | 2 m | Rinse | 2 m | S2C | 2 m | 10 |

As can be seen in Table 2, the panels treated with the permanganate and lithium containing compositions according to embodiments of the present invention exhibit good corrosion resistance.

Additional panels were tested in a manner similar to that described above. Specifically, triplicate panels (panels A, B and C) of Bare A12024-T3 (available from Continental Steel & Tube Company, Fort Lauderdale, Fla.) were treated in the manner set forth below and shown in the following Table 3. The panels were treated at room temperature, i.e., approximately 25° C. The abbreviations for the compositions in Table 3 are found in the descriptions of the Examples above.

First, a de-greaser was applied to the panels for 3.5 minutes. The degreaser used was either RECC 1001 (panels 22-29), 88X002 (panels 38), or DFM 10 (panels 30-37), all of which degreasers are available from PRC-DeSoto International, Inc., Sylmar, Calif. After application of the degreaser, each panel was rinsed with deionized water for 2 minutes. A deoxidizer composition (i.e., a solution including 1.25 g of ascorbic acid, 83 mL of nitric acid and enough deionized water to make 1 liter) was then applied to the panels for 2.5 minutes, followed by a 2 minute rinse with deionized water. Then, the permanganate-containing composition according to Example 2 (i.e., Soln 1) was applied to each panel for 2-10 minutes (as indicated in the Table), followed by a 2 minute rinse with deionized water. Following the rinse, the lithium-containing composition listed in the Table was applied to each panel for 2-3 minutes (as indicated in the Table).

After treatment, the performance of each of the treated panels was measured by a 4 day neutral salt spray test run in accordance with ASTM B 117. The test panels were rated according to the ELM Scale, described above. The ELM rating for each panel, reported as an average rating of the triplicate panels (A-C) for each listed panel, is shown in Table 3.

TABLE 3

| Panels A-C | App I Degrease | App II Rinse | App III | App IV | App V | Time V | App V | App V | Time V | ELM 4 day salt spray |
|---|---|---|---|---|---|---|---|---|---|---|
| 22 | RECC 1001 (3.5 m) | Rinse (2 m) | AA (2.5 m) | Rinse (2 m) | Soln 1 | 2 m | Rinse (2 m) | SIB | 2 m | 5 |
| 23 | RECC 1001 (3.5 m) | Rinse (2 m) | AA (2.5 m) | Rinse (2 m) | Soln 1 | 10 m | Rinse (2 m) | SIB | 2 m | 8 |
| 24 | RECC 1001 (3.5 m) | Rinse (2 m) | AA (2.5 m) | Rinse (2 m) | Soln 1 | 2 m | Rinse (2 m) | SIB-BTA | 3 m | 4 |
| 25 | RECC 1001 (3.5 m) | Rinse (2 m) | AA (2.5 m) | Rinse (2 m) | Soln 1 | 10 m | Rinse (2 m) | SIB-BTA | 3 m | 7 |
| 26 | RECC 1001 (3.5 m) | Rinse (2 m) | AA (2.5 m) | Rinse (2 m) | Soln 1 | 2 m | Rinse (2 m) | SIB-CV | 2 m | 7 |
| 27 | RECC 1001 (3.5 m) | Rinse (2 m) | AA (2.5 m) | Rinse (2 m) | Soln 1 | 10 m | Rinse (2 m) | SIB-CV | 2 m | 10 |

TABLE 3-continued

| Panels A-C | App I Degrease | App II Rinse | App III | App IV | App V | Time V | App V | App V | Time V | ELM 4 day salt spray |
|---|---|---|---|---|---|---|---|---|---|---|
| 28 | RECC 1001 (3.5 m) | Rinse (2 m) | AA (2.5 m) | Rinse (2 m) | Soln 1 | 2 m | Rinse (2 m) | S2B | 2 m | 6 |
| 29 | RECC 1001 (3.5 m) | Rinse (2 m) | AA (2.5 m) | Rinse (2 m) | Soln 1 | 10 m | Rinse (2 m) | S2B | 2 m | 8 |
| 30 | DFM10 (3.5 m) | Rinse (2 m) | AA (2.5 m) | Rinse (2 m) | Soln 1 | 2 m | Rinse (2 m) | SIB | 2 m | 4 |
| 31 | DFM10 (3.5 m) | Rinse (2 m) | AA (2.5 m) | Rinse (2 m) | Soln 1 | 10 m | Rinse (2 m) | SIB | 2 m | 7 |
| 32 | DFM10 (3.5 m) | Rinse (2 m) | AA (2.5 m) | Rinse (2 m) | Soln 1 | 2 m | Rinse (2 m) | SIB-BTA | 3 m | 3 |
| 33 | DFM10 (3.5 m) | Rinse (2 m) | AA (2.5 m) | Rinse (2 m) | Soln 1 | 2 m | Rinse (2 m) | S1B-BTA | 3 m | 7 |
| 34 | DFM10 (3.5 m) | Rinse (2 m) | AA (2.5 m) | Rinse (2 m) | Soln 1 | 2 m | Rinse (2 m) | SIB-CV | 2 m | 6 |
| 35 | DFM10 (3.5 m) | Rinse (2 m) | AA (2.5 m) | Rinse (2 m) | Soln 1 | 2 m | Rinse (2 m) | SIB-CV | 2 m | 8 |
| 36 | DFM10 (3.5 m) | Rinse (2 m) | AA (2.5 m) | Rinse (2 m) | Soln 1 | 2 m | Rinse (2 m) | S2B | 2 m | 5 |
| 37 | DFM10 (3.5 m) | Rinse (2 m) | AA (2.5 m) | Rinse (2 m) | Soln 1 | 2 m | Rinse (2 m) | S2B | 2 m | 9 |
| 38 | 88X002 (3.5 m) | Rinse (2 m) | AA (2.5 m) | Rinse (2 m) | Soln 1 | 2 m | Rinse (2 m) | SIB-BTA | 2 m | 9 |

As can be seen from Table 3, the treatment method may affect the performance of the treated substrate. For example, certain combinations of degreaser or deoxidizer, permanganate solutions, and lithium solutions show enhanced corrosion resistance performance as compared to other combinations. Additionally, although certain panels (e.g., panels 32 and 33) which were treated in an identical manner may register different ELM ratings, it can be seen that certain of those panels registered reasonably high ELM ratings. This indicates that the application procedure and compositions used on those panels can produce desirable results, and that perhaps there was a flaw or error in the underperforming panel unrelated to the application method or sequence, or the compositions.

Whereas particular embodiments of the present disclosure have been described above for purposes of illustration, it will be understood by those of ordinary skill in the art that numerous variations of the details of the present disclosure may be made without departing from the invention as defined in the appended claims, and equivalents thereof. For example, although embodiments herein have been described in connection with "a" permanganate, and the like, one or more permanganate or any of the other components recited can be used according to embodiments of the present disclosure.

Although various embodiments of the present disclosure have been described in terms of "comprising" or "including," embodiments "consisting essentially of" or "consisting of" are also within the scope of the present disclosure. For example, while the present disclosure describes a composition including a permanganate source and a carrier, a composition and/or a solution consisting essentially of or consisting of the permanganate source and the carrier is also within the scope of the present disclosure. Similarly, although a permanganate source comprising or including a permanganate salt is described, permanganate sources consisting essentially of or consisting of a permanganate salt are also within the scope of the disclosure. Thus, as described above, the composition may consist essentially of the permanganate source and the carrier. In this context, "consisting essentially of" means that any additional components in the composition will not materially affect the corrosion resistance of a metal substrate including the composition. For example, a composition consisting essentially of a permanganate source and a carrier is free from anions other than permanganate.

As used herein, unless otherwise expressly specified, all numbers such as those expressing values, ranges, amounts or percentages may be read as if prefaced by the word "about," even if the term does not expressly appear. Further, use of the word "about" reflects the penumbra of variation associated with measurement, significant figures, and interchangeability, all as understood by a person having ordinary skill in the art to which this disclosure pertains. Any numerical range recited herein is intended to include all sub-ranges subsumed therein. Plural encompasses singular and vice versa. For example, while the present disclosure describes "a" permanganate source, a mixture of such permanganate sources can be used. When ranges are given, any endpoints of those ranges and/or numbers within those ranges can be combined within the scope of the present disclosure. The terms "including" and like terms mean "including but not limited to." Similarly, as used herein, the terms "on," "applied on," and "formed on" mean on, applied on, or formed on, but not necessarily in contact with the surface. For example, a composition "applied on" a substrate does not preclude the presence of one or more other coating layers or compositions of the same or different composition located between the applied composition and the substrate.

Notwithstanding that the numerical ranges and parameters set forth herein may be approximations, numerical values set forth in the specific examples are reported as precisely as is practical. Any numerical value, however, inherently contains certain errors necessarily resulting from the standard variation found in their respective testing measurements. The word "comprising" and variations thereof as used in this description and in the claims do not limit the disclosure to exclude any variants or additions.

What is claimed is:

1. A method of treating a substrate comprising: applying a first composition to at least a portion of the surface the first composition comprising a carrier, a permanganate anion source, and a corrosion inhibitor comprising a metal cation comprising a rare earth ion, an alkali metal ion, an alkaline earth metal ion, and/or a transition metal ion present in an amount of 0.0008 to 0.004 percent by weight based on the total weight of the composition, wherein the corrosion inhibitor is different from the permanganate anion source;

followed by applying a second composition to at least a portion of the surface to which the first composition was applied, the second composition comprising a lithium source and a second carrier.

2. The method of claim 1, wherein the permanganate is present in an amount of at least 0.008 percent by weight based on total weight of the composition.

3. The method of claim 1, wherein the first composition further comprises an azole.

4. The method of claim 3, wherein the azole compound comprises a cyclic compound comprising at least one nitrogen atom, at least one oxygen atom, and/or at least one sulfur atom.

5. The method of claim 3, wherein the azole compound is present in an amount of 0.0005 g per liter to 3 g per liter based on total composition.

6. The method of claim 1, wherein the first composition comprises an indicator compound.

7. The method of claim 6, wherein the indicator compound is present in an amount of 0.01 g/1000g composition to 3 g/1000 g composition.

8. The method of claim 1, wherein the lithium is present in an amount of 0.02 g/1000 g composition to 12 g/1000 g composition.

9. The method of claim 1, wherein the second composition further comprises a transition metal, an azole, and/or an indicator compound.

10. The method of claim 9, wherein the azole compound comprises a cyclic compound comprising at least one nitrogen atom, at least one oxygen atom, and/or at least one sulfur atom.

11. The method of claim 1, further comprising rinsing the substrate prior to applying the second composition.

12. The method of claim 1, further comprising applying a degreasing composition, a deoxidizing composition, and/or a cleaning composition to at least a portion of the surface of the substrate prior to the applying the first composition to at least a portion of the surface of the substrate.

13. The method of claim 12, wherein the cleaning composition is acidic.

14. The method of claim 12, wherein the cleaning composition is alkaline.

15. The method of claim 12, further comprising rinsing the substrate prior to the applying the first composition.

* * * * *